US005273298A

United States Patent [19]

Brown, Sr.

[11] Patent Number: 5,273,298

[45] Date of Patent: Dec. 28, 1993

[54] COMBINED CARRIER AND STORAGE DEVICE FOR BASEBALL OR SOFTBALL TEAM EQUIPMENT HAVING PLAYING FIELD LINING CAPABILITY

[76] Inventor: Donald C. Brown, Sr., 320 West Fourth St., Uhrichsville, Ohio 44683

[21] Appl. No.: 973,274

[22] Filed: Nov. 9, 1992

[51] Int. Cl.[5] ..... B62B 1/10

[52] U.S. Cl. ..... 280/47.19; 280/47.26; 280/79.2; 222/608; 206/315.1

[58] Field of Search ..... 280/47.19, 47.17, 47.26, 280/24.24, 79.2, DIG. 6, 47.35; 206/315.1, 315.3, 315.4, 315.5; 294/146, 159; 222/608, 611.1, 510, 518

[56] References Cited

U.S. PATENT DOCUMENTS

| | | | |
|---|---|---|---|
| D. 184,838 | 4/1959 | Tucker | D14/3 |
| D. 203,107 | 12/1965 | Hardy | D14/3 |
| D. 223,149 | 3/1972 | Gonzalez | D34/24 |
| D. 263,690 | 4/1982 | Laub | D12/2 |
| D. 268,372 | 3/1983 | Knott | D34/25 |
| D. 280,859 | 10/1985 | Ott | D34/25 |
| D. 283,846 | 5/1986 | Wessel | D3/36 |
| 1,050,669 | 1/1913 | Lee | 222/608 |
| 2,493,599 | 1/1950 | Schroeder | 222/608 |
| 2,889,863 | 6/1959 | Arnold, Jr. | 150/1.5 |
| 3,977,521 | 8/1976 | Murphy | 206/315.1 |
| 4,890,731 | 1/1990 | Mroz | 206/315.1 |
| 4,951,818 | 8/1990 | Johnson | 206/315.1 |
| 4,968,048 | 11/1990 | Lortie | 206/315.1 |

*Primary Examiner*—Richard M. Camby

[57] ABSTRACT

This invention relates to an improved compartmentalized carrier and storage device for baseball and softball team equipment for its easy transport and use. The carrier is comprised of two separate enclosures which are detachably combined, the first for storage of the team equipment and the second for lining the base lines and distances of the bases for standardized field playing conditions. The carrier is wheeled for easy transport and for forming the straight base lines of the playing field.

20 Claims, 2 Drawing Sheets

COMBINED CARRIER AND STORAGE DEVICE FOR BASEBALL OR SOFTBALL TEAM EQUIPMENT HAVING PLAYING FIELD LINING CAPABILITY

TECHNICAL FIELD

This invention relates generally to team equipment carriers and storage devices, and especially to an improved carrier for baseball or softball team equipment for its easy transport and use. More particularly, it relates to such carriers and methods for transporting and storing varied items of such team equipment and having playing field lining capability to facilitate the initiation of baseball and softball games. The equipment is maintained readily accessible and accounted for in the subject combined carrier both prior to and subsequent to the use of the required equipment in such team sports.

BACKGROUND ART

Prior to baseball and softball games, the team equipment must be readily available to the team members and their coaches. Heretofore, it has been common practice to store and transport such team equipment in a canvas bag with all the equipment gathered therein randomly in no particular order. It is usually impossible to determine whether all the necessary team equipment items are present in such bag, both prior to and subsequent to the games without their removal from the bag and making an accounting. Individual items of team equipment can be lost, strayed or stolen at any time, especially after games when players and/or coaches are celebrating victory or commiserating defeat. It is a very difficult task for coaches and batboys to ensure that all items of team equipment are properly gathered and stored in the bag, the bag having very restricted visibility only through its top opening. This is true of bats, balls, gloves, bases, catchers equipment, helmets and the like. Frequently, the bag must be emptied to make the required accounting, both before and after games. The bats are normally thrown into the bag in random fashion and due to their size and number make the accounting even more difficult.

It has been conventional practice prior to a game to dump all of the varied items of team equipment, including the bats, onto the ground adjacent the team dugout where the various items are sorted out and utilized as required. Usually there is no organized pattern for maintaining all of the equipment in any prescribed order, frequently resulting in losses of team equipment due to various reasons. After a game, the assemblying and storing of the equipment is a haphazard affair and sometimes losses of equipment are not detected until the next game.

The subject carrier is intended to prevent such losses. In addition, prior to a game it is not unusual for the playing field to be wet or soggy due to rain requiring the playing field to be shifted and marked off in an adjacent area near the conventional playing surface. Such relocation requires establishing new base lines and base distances to permit playing the game under standardized conditions on essentially dry ground. The present invention is directed toward eliminating the aforesaid difficulties of lining a playing field and preventing team equipment losses.

It is a general object of this invention to provide a novel and improved device for retaining and storing team equipment in a combined multipurpose readily-transportable carrier.

A more specific object of this invention is to provide a novel and improved combined carrier which will facilitate maintaining all of the game equipment for a single team in proper order for easier and quicker location, use and storage by team members, and which will facilitate lining off of the playing field as required prior to games.

Another object of this invention is to provide a combined baseball bat rack and equipment carrier which enable the bats, balls and other equipment to be consistently arranged in an orderly compact unit which can be easily transported on integral wheels and which will permit field lining in an expedient and accurate manner.

Another object of this invention is to provide a combined carrier and storage device for team equipment which is wheeled and which can be used integrally for playing field lining as required, the device having plural compartments and a viewable front side for equipment accounting.

A still further object of this invention is to provide a combined field lining enclosure and an equipment storing enclosure combined into a unitary carrier device having a single set of wheels for easy transport and expedient field lining employing fine particulate material uniformly distributed in linear fashion, the individual twin enclosures being integrally joined for combined use and separable for servicing as required.

BRIEF DESCRIPTION OF THE DRAWINGS

The aforesaid objects and features of this invention and the manner of attaining them will readily become apparent and the invention herein disclosed will be best understood by reference to the following description of the invention in conjunction with the accompanying drawings, wherein.

In the accompanying drawings, like reference characters refer to the same or similar parts throughout the several views.

DETAILED DESCRIPTION OF A PREFERRED EMBODIMENT

Figure 1:
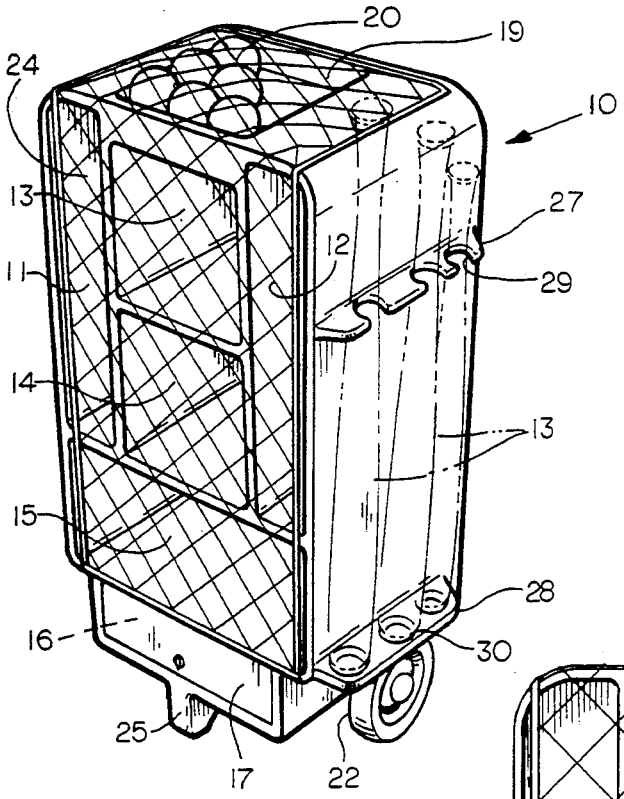
FIG. 1 is a perspective partially frontal view of an equipment carrier and storage device which is constructed according to the present invention.

One preferred embodiment of my invention as shown in FIG. 1 includes an upright, vertically-elongated first enclosure 10 which is generally rectangular in shape. This enclosure is substantially rigid and formed from durable moldable plastic material such as high-density polyethylene or other plastic material such as polypropylene having glass fibers embedded therein for strength and lightweight. The enclosure has an open top and front side with a plurality of individual compartments formed therewithin. The open top forms a tray-like cavity or compartment having raised sides into which a substantial number of baseballs or softballs may be stored.

A second enclosure 35 is detachably mounted on the back side of the first enclosure 10 for field lining purposes which will be described in greater detail subsequently.

The interior of the first enclosure 10 has a series of internal chambers or compartments such as those designated by the numerals 11, 12, 13, 14 and 15 designed to receive and retain various items of team equipment. Interior compartments 11 and 12 preferably have a lengthy vertical dimension. Compartment 11 holds both of the catcher's shin guards in nested relation. Compartment 12 holds the catcher's chest protector and catcher's mitt. The intermediate inner compartments 13 and 14 preferably having an essentially square shape hold a plurality of batting helmets in nested relation. Compartment 15 also holds a pair of helmets in sideways relation with the catcher's mask inserted between the pair of helmets. The home plate and three individual bases may also be stored in compartment 15. Obviously, the preferred storage of the team equipment items may be varied from the aforesaid arrangement as desired depending upon their relative sizes and numbers.

Another compartment 16 is located immediately beneath open compartment 15 having a hinged door 17 to store a medicine kit and scorebook as well as other team materials such as rosters and schedules. A rolled-up flexible chalkline or cord having a length of up to about 350 feet may also be stored in compartment 16 for straight lining of the base lines. The top surface of the enclosure 10 has an open tray-like compartment 19 having a square or rectangular shape with peripheral ridges at least as high as the game ball diameters or about 2 to 4 inches to retain a plurality of baseballs or softballs designated by the numeral 20.

The lower portion of the first enclosure 10 is recessed on its opposite sides to facilitate the mounting of a pair of spaced-apart freely-rotatable wheels 21 and 22 on the carrier. The wheels are preferably mounted to fit within the sides of the carrier so as not to project exteriorly therefrom for easy handling and transport of the carrier.

The pair of wheels are normally attached at the rearward area of the carrier first enclosure 10 or at a midpoint for upright stability along with post member 25.

Figure 2:
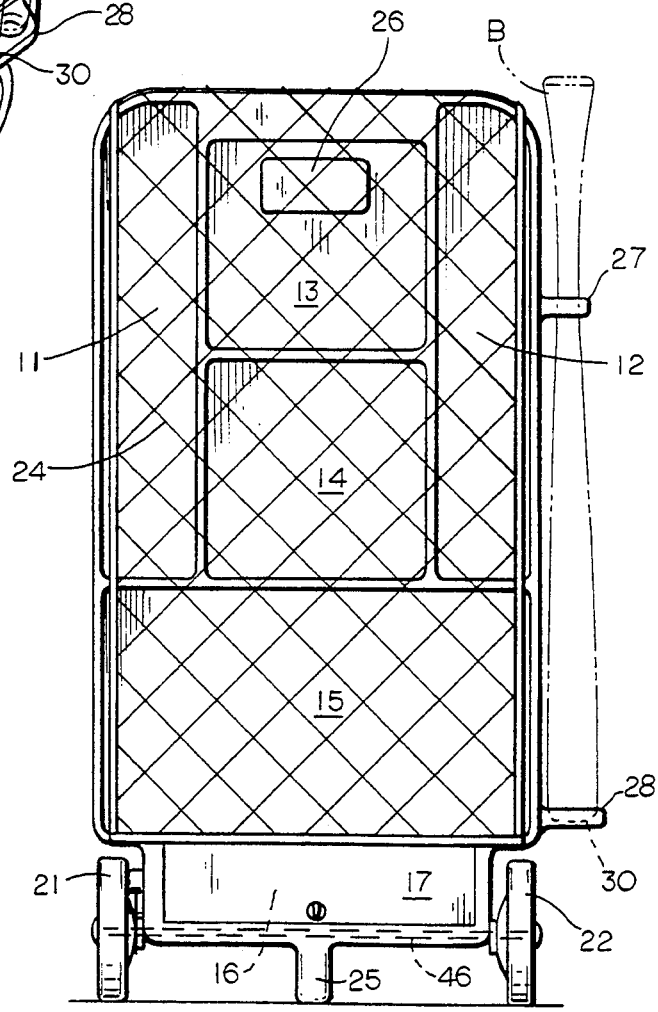
FIG. 2 is a front elevational view of the subject carrier and storage device shown in FIG. 1.

The open compartments of the carrier are covered with an open net member 24 such as durable tennis net material to cover both the open top and front side open compartments of the carrier. The net may also be comprised of clear vinyl sheet material. The netting or sheet material has a width and length to cover the full expanse of all of the open compartments including the tray-like top surface. The netting 24 is permanently attached at the top rear area of the enclosure 10 such as by a metal strip (not shown) and extends downwardly to the lower edge of lower open compartment 15. The netting 24 has a Velcro strip along its full width at its lower end which interconnects with a second Velcro strip permanently mounted along the lower edge of compartment 16. The Velcro strips are not shown in FIGS. 1 and 2 but are conventional in the fastening art. In order to open the carrier for access to the stored equipment, the open netting 24 is separated at the Velcro strips and lifted upwardly and laid back over the rear of the main first enclosure 10. Or alternately, the netting can be rolled up and placed at the rear of the uppermost tray-like compartment 19. Closing of the carrier is readily accomplished by returning the netting to its attachment at the lower front.

The open nature of the netting 24 permits full viewing of the compartments and stored items to ensure that all team equipment materials are present and accounted for both before and after games to be certain of their availability and to prevent loss of same.

The frontal portion of the first enclosure 10 has a rigid post member 25 molded into its lower frontal region beneath compartment 16. The post member 25 has a vertical dimension so that along with wheels 21 and 22 the carrier has a level three-point stance to maintain the same in stable upright position. Obviously, the carrier can be used in both upright and horizontal positions as desired. The carrier is normally grasped by handhold 26 in the backside of the carrier and tilted slightly rearwardly when moved on its wheels when transported. The handhold also serves to lift the carrier when stored in an automobile trunk.

The pair of wheels 21 and 22 are connected to a single axle 46 which extends horizontally beneath compartment 16. The wheels may be formed of rigid plastic material to save weight and may have rubber tires thereon for smoother transport.

A pair of elongated bat rack members 27 and 28 are attached to at least one side of the carrier with each having a series of apertures 29 and 30 therein for retaining the handles and barrel ends of the bats B respectively. The racks 27 and 28 are shown in FIG. 1 having at least four (4) such apertures to receive the upper and lower portions of the bats to hold the same vertically. The juxtaposed slots or apertures may be numbered as desired to maintain the bats in a prescribed order. Similar bat racks may be attached on the other side of the carrier in order to retain a greater number of bats than the limited number shown in FIG. 1. Obviously, the racks 27 and 28 may have a greater number of apertures than those shown to retain a greater number of bats on one side of the carrier. The racks 27 and 28 may be integrally molded into the exterior side surfaces of the first enclosure 10 when originally formed such as by molding or may be subsequently attached such as by an adhesive in the case of separate bat rack members.

Figure 3:
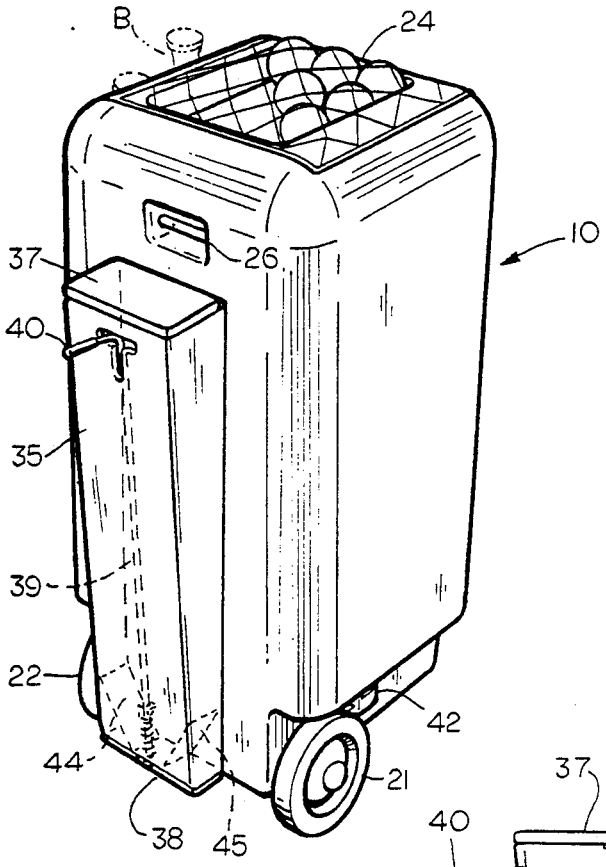
FIG. 3 is a perspective partially rear view of the subject carrier and storage device shown in FIGS. 1 and 2.
Figure 4:
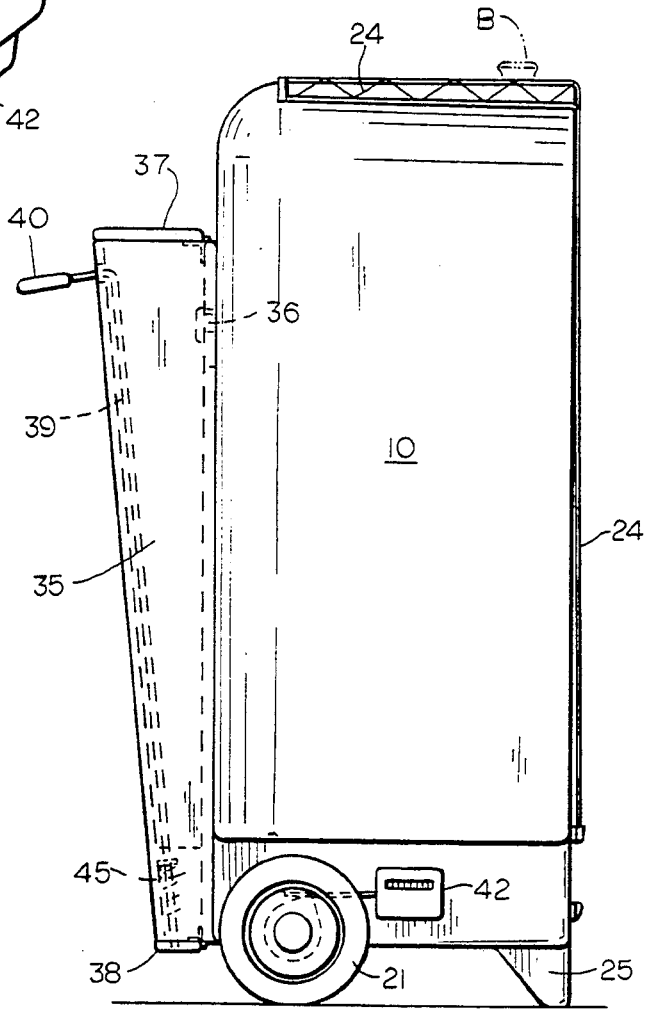
FIG. 4 is a side elevational view of the subject carrier and storage device shown in the above FIGS. 1, 2 and 3.

The second enclosure 35 has a generally rectangular shape and is smaller than first enclosure 10. The second enclosure has slightly sloping sides and is mounted in detachable relation on the back or rearward side of enclosure 10 in face-to-face relation. The first enclosure 10 preferably has two or three post members 36 (two being shown in FIG. 4) mounted in spaced apart relation which fit into complemental openings or slots in an upper region of the second enclosure 35 for rigid attachment. The post members 36 have larger heads than their shank portions for tightly fitting into the slots in the facing side of the second enclosure. Second enclosure 35 has a spring-hinged cover 37 at an upper top region for closing the top and placing fine particulate material such as lime or flour or the like into such enclosure for base lining purposes. The second enclosure has a spring-hinged door 38 closing a bottom opening therein which has a width of about 2 to 3 inches to form base lines. The interior of the lining enclosure 35 has a pair of sloping internal baffles 44 and 45 which are mounted interiorly in a lower region to direct the particulate material to the limited opening in the bottom for line-forming width. Such baffles are shown in dotted line in FIG. 3.

Figure 5:
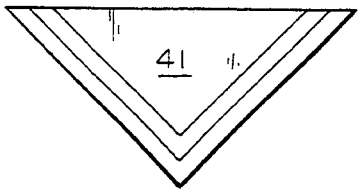
FIG. 5 is a top plan view of a triangular sheet of flexible plastic material which is used to initiate formation of the base lines of the playing field.

A lengthy shaft 39 extends downwardly interiorly from an upper projecting handle 40 to interconnect with bottom hinged door 38 to open and close the bottom opening. When the lining device of the combined carrier is used to line the base lines, a triangular sheet 41 of plastic material having a right-angle lower portion as shown in FIG. 5 is taken and laid out at the home plate area and is used to form the initial areas of the base lines. The stored chalkline or cord is preferably stretched out in taut relation from home plate to form straight base lines. The sheet 41 may be rolled up and stored in compartment 16 of the carrier when not in use.

In order to properly line the playing field, the carrier is tilted rearwardly toward the lining enclosure 35 and wheeled over the base lines with bottom opening door 38, open to dispense the fine base line material to form the base lines. A distance counter 42 is mounted adjacent to wheel 21 and is cammed thereto to measure prescribed distances of 60 or 90 feet to establish the first and third base dimensions of the playing field or so-called diamond. The wheeled carrier ensures uniform delivery of the lining material when moved at a uniform rate of travel of the combined carrier over the base lines to be formed. The lining capability is especially useful when a temporary playing field must be established due to unavailability of a normally-used pre-marked field. The lining enclosure 35 is separable from the primary enclosure 10 to facilitate its cleaning and reloading with the fine particulate lining material prior to their rejoinder into a combined carrier.

Various modifications may be resorted to within the spirit and scope of the appended claims.

I claim:

1. A transportable carrier and storage device for baseball and softball team equipment and having playing field lining capability comprising, in combination, a first hollow enclosure having a plurality of hollow compartments adapted to retain varied items of team equipment and a second hollow enclosure adapted to retain and deliver fine particulate material to line a baseball or softball playing field, both said first and second hollow enclosures being substantially rectangular in shape with said second enclosure being detachably mounted on said first enclosure, said first enclosure having a pair of spaced-apart freely-rotatable wheels for easy transport of said carrier and storage device with field lining capability.

2. The transportable carrier and storage device in accordance with claim 1, wherein said second enclosure has lower bottom opening and closing means to open and close said lower opening for delivery of said fine particulate material for lining said playing field.

3. The transportable carrier and storage device in accordance with claim 2, wherein said bottom opening and closing means comprises a long-handled shaft connected to a lower bottom hinged member for delivery of said fine particulate material to form playing field lines.

4. The transportable carrier and storage device in accordance with claim 1, wherein the top and front portions of said plurality of hollow compartments in said first enclosure are open, faced and covered by a hinged flexible cover member at least partially transparent to view the contents of said first enclosure.

5. The transportable carrier and storage device in accordance with claim 1, wherein said first hollow enclosure having said plurality of hollow compartments is substantially larger than said second hollow enclosure.

6. The transportable carrier and storage device in accordance with claim 1, wherein said plurality of hollow compartments are varied in size to retain individual items of team equipment, all being substantially rectangular in shape and having frontal openings to receive and store said individual items.

7. The transportable carrier and storage device in accordance with claim 1, wherein both said first and second hollow enclosures are separately molded of moldable plastic material as substantially one-piece twin body members adapted to be detachably joined together as a combined device for performing the stated multiple functions.

8. The transportable carrier and storage device in accordance with claim 4, wherein said hinged flexible cover member comprises a substantially rectangular net member adapted to attachment at both top and bottom areas of said first enclosure to retain stored team equipment therewithin.

9. The transportable carrier and storage device in accordance with claim 1, including distance measuring means connected to at least one of said pair of freely-rotatable wheels to measure the length of base lines of said playing field.

10. The transportable carrier and storage device in accordance with claim 9, wherein said distance measuring means comprises a counter calibrated to the wheel circumference of one of said pair of wheels.

11. The transportable carrier and storage device in accordance with claim 1, including a pair of elongated apertured bat rack members mounted in juxtaposed horizontal relation at top and bottom areas on at least one exterior side of said first hollow enclosure to retain a plurality of bats in substantially parallel vertical relation.

12. In combination, a transportable carrier and storage device for baseball and softball team equipment and an associated field lining device comprising a first hollow enclosure having a plurality of open-faced hollow compartments in its top and front surfaces adapted to retain varied items of team equipment and a second hollow enclosure adapted to retain and controllably deliver fine particulate material to line a baseball or softball playing field, both said first and second hollow enclosures being substantially rectangular in shape with said second enclosure being detachably mounted on the closed backside of said first enclosure, said first enclosure having a pair of spaced-apart freely-rotatable wheels mounted at a lower region thereof for easy transport of said combined carrier and storage device and said field lining device.

13. The combination in accordance with claim 12, wherein both said first hollow enclosure and said second hollow enclosure have complemental planar surfaces for their detachable joinder in face-to-face relationship.

14. The combination in accordance with claim 12, including a flexible open-apertured netting member attached to the top surface of said first hollow enclosure adapted to cover said top and front open-faced surfaces of said hollow compartments of said first hollow enclosure to retain said varied items of team equipment.

15. The combination in accordance with claim 12, including a distance measuring counter mounted on a lower region of said first hollow enclosure to measure the distance of base lines of said playing field.

16. The combination in accordance with claim 12, including at least one closed compartment having a hinged door in a lower region of said first hollow enclosure for storage of lesser-used items of team equipment.

17. The combination in accordance with claim 12, wherein said second hollow enclosure has lower bottom opening and closing means to open and close a limited bottom opening for continuous delivery of said fine particulate material when open for lining the base lines of said playing field.

18. The combination in accordance with claim 17, wherein said lower bottom opening and closing means comprises a long-handled shaft connected to a lower bottom hinged member for delivery of said fine particulate material to form playing field lines.

19. The combination in accordance with claim 12, including a pair of lengthy apertured rack members mounted horizontally in juxtaposed relation at top and bottom areas on at least one side of said first hollow enclosure to retain a plurality of bats in substantially parallel vertical relation exteriorly of said first hollow enclosure.

20. The combination in accordance with claim 12, including a separate sheet of thin flexible plastic material having a triangular shape and a right-angled portion having base lines thereon to initiate the formation of base lines on the playing field using said second hollow enclosure for field lining.

* * * * *